US006401986B1

(12) United States Patent
Randall

(10) Patent No.: US 6,401,986 B1
(45) Date of Patent: Jun. 11, 2002

(54) DISPENSING STRUCTURE WITH A VENTING FEATURE

(75) Inventor: Jeffrey T. Randall, Oconomowoc, WI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 09/775,907

(22) Filed: Feb. 2, 2001

(51) Int. Cl.[7] ..... B65D 47/08
(52) U.S. Cl. ..... 222/212; 222/482; 222/556
(58) Field of Search ..... 222/482, 556, 222/212

(56) References Cited

U.S. PATENT DOCUMENTS

| | | | | | |
|---|---|---|---|---|---|
| 4,231,489 | A | * | 11/1980 | Malone | 220/304 |
| 4,310,102 | A | * | 1/1982 | Walter | 222/570 X |
| 4,625,899 | A | * | 12/1986 | Stull | 222/521 |
| 4,646,947 | A | * | 3/1987 | Stull | 222/397 |
| 4,773,572 | A | * | 9/1988 | Stull | 222/521 |
| 5,547,091 | A | * | 8/1996 | Neveras et al. | 222/212 X |
| 5,577,625 | A | * | 11/1996 | Baird et al. | 222/212 X |
| 5,620,107 | A | * | 4/1997 | Takeuchi | 215/235 |
| 5,938,087 | A | * | 8/1999 | Randall | 222/547 |

* cited by examiner

*Primary Examiner*—Kenneth Bomberg
(74) *Attorney, Agent, or Firm*—Wood, Phillips, Katz, Clark & Mortimer

(57) ABSTRACT

A dispensing structure is provided for dispensing the contents from the interior of a container out of an opening in the container. The structure includes a body for mounting to the container at the container opening. The body is adapted for movement in directions toward and away from the container. The body defines a dispensing orifice for establishing communication between the exterior and interior of the container. The body has a sealing member for being disposed in the container opening. The sealing member has an outer sealing surface for sealingly engaging the container around the container opening when the body is located at a first sealing position relative to the container. The sealing member defines a vent passage extending inwardly from the outer sealing surface for communicating with the container interior whereby movement of the body in the direction away from the container a sufficient amount to a venting position locates a portion of the vent passage outwardly of the container opening to establish communication between the container interior and the container exterior. A lid is provided to accommodate movement between a closed position occluding the body dispensing orifice and an open position away from the body dispensing orifice.

7 Claims, 3 Drawing Sheets

20A
40A
92A
91A
46A
88A
52A
H
25A
60A
56A
96A
80A
42A
84A
70A
36A
34A
71A
30A
24A
26A
22A

DISPENSING STRUCTURE WITH A VENTING FEATURE

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a system for dispensing a product from a container. This invention is more particularly related to a system that can equalize the pressure between the ambient atmosphere and the interior of a container prior to dispensing the product from the container.

BACKGROUND OF THE INVENTION AND TECHNICAL PROBLEMS POSED BY THE PRIOR ART

A variety of packages, including dispensing packages or containers, have been developed for food products, including carbonated beverages, and for personal care products such as shampoo, lotion, etc., as well as for other materials. Such containers typically have a neck defining an open upper end on which is mounted a dispensing closure.

Typically, the closure includes a body mounted on the container neck. The body defines a dispensing orifice. A lid is mounted to the body for opening and closing the dispensing orifice.

The inventor of the present invention has determined that it would be advantageous to provide an improved dispensing structure for covering the product in the container while at the same time accommodating venting of gases out of, or into, the container to equalize the pressure prior to dispensing the container contents through the dispensing structure. This would permit, for example, microwave heating of a food product in the container wherein steam or other gases driven off in the heating process could readily escape. Such an improved structure could also permit in-venting of ambient atmosphere into a sub-atmospheric container interior—as during cooling of a heated container in a refrigerator—to prevent an undesirable pressure differential. Such a structure could also permit pressurized gases from a carbonated beverage to escape prior to dispensing the beverage.

Such an improved dispensing structure should accommodate designs for separately mounting the dispensing structure on the container in a secure manner.

It would also be beneficial if such an improved dispensing structure could readily accommodate its manufacture from a variety of different materials.

Further, it would be desirable if such an improved dispensing structure could be provided with a design that would accommodate efficient, high-quality, large volume manufacturing techniques with a reduced product reject rate.

Preferably, the improved dispensing structure should also accommodate high-speed manufacturing techniques that produce products having consistent operating characteristics unit-to-unit with high reliability.

The present invention provides an improved dispensing structure which can accommodate designs having the above-discussed benefits and features.

SUMMARY OF THE INVENTION

According to one aspect of the present invention, a dispensing structure is provided for discharging the contents from the interior of a container out of an opening in the container. The dispensing structure includes a body for extending from the container. The body defines a dispensing orifice for establishing communication between the exterior and interior of the container.

The body is adapted for mounting to the container at the container opening. The body is adapted for movement in directions toward and away from the container. The body has a sealing member for being disposed in the container opening. The sealing member has an outer sealing surface for sealingly engaging the container around the container opening when the body is located at a first sealing position relative to the container. The sealing member defines a vent passage extending inwardly from the outer sealing surface for communicating with the container interior. Movement of the body in the direction away from the container a sufficient amount to a venting position locates a portion of the vent passage outwardly of the container opening to establish communication between the container interior and the container exterior.

The dispensing structure includes a lid which accommodates movement between (1) a closed position occluding the body dispensing orifice for preventing the dispensing of the container contents through the body dispensing orifice, and (2) an open position away from the body dispensing orifice to accommodate pouring of the contents of the container through the body dispensing orifice.

The lid can be maintained in the closed position as the dispensing structure body is moved from the first sealing position to the venting position. When the body is in the venting position, a pressure difference between the container interior and container exterior can be equalized by flow of gas into, or out of, the container while the lid is closed. Subsequently, after pressure within the container has equalized with the pressure exterior of the container, the lid can be opened, and the contents, or portion of the contents, can be dispensed through the body dispensing orifice.

In a preferred form of the invention, the dispensing structure is a separate closure which includes a closure body having internal threads adapted for threadingly engaging external threads on a neck of a container. When the closure body is in the venting position, the gas can flow into or out of the container through the vent passage and through the threaded engagement between the closure body and the container—which threaded engagement is not gas-tight.

Numerous other advantages and features of the present invention will become readily apparent from the following detailed description of the invention, from the claims, and from the accompanying drawing.

BRIEF DESCRIPTION OF THE DRAWINGS

In the accompanying drawings that form part of the specification, and in which like numerals are employed to designate like parts throughout the same.

FIG. 2 shows a portion of the structure broken away to reveal interior details;

DESCRIPTION OF THE PREFERRED EMBODIMENTS

While this invention is susceptible of embodiment in many different forms, this specification and the accompanying drawings disclose only one specific form as an example of the invention. The invention is not intended to be limited to the embodiment so described, however. The scope of the invention is pointed out in the appended claims.

For ease of description, most of the figures illustrating the invention show a dispensing system in the typical orientation that it would have at the top of a container when the container is stored upright on its base, and terms such as upper, lower, horizontal, etc., are used with reference to this position. It will be understood, however, that the dispensing structure and system of this invention may be manufactured, stored, transported, used, and sold in an orientation other than the position described.

The dispensing system of this invention is suitable for use with a variety of conventional or special containers having various designs. It will also be understood by those of ordinary skill that some novel and non-obvious inventive aspects are embodied in the described exemplary closure systems per se apart from any containers with which the closure system may be used.

Figure 1:
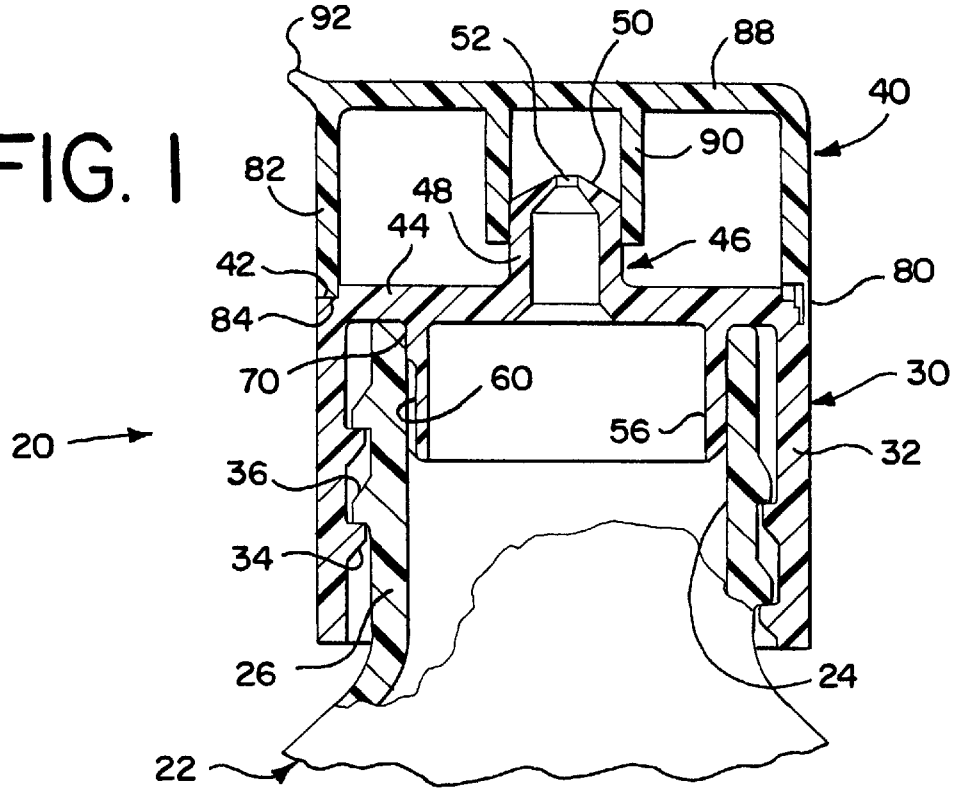
FIG. 1 is a fragmentary, cross-sectional view of a first embodiment of the dispensing structure of the present invention which comprises a separate closure that is mounted on a container in a first sealing position and that includes an attached lid shown in a closed position.

A first embodiment of the dispensing structure of the present invention is illustrated in FIGS. 1–5 in the form of a dispensing closure designated generally in many of the figures by the reference number 20. The dispensing structure or closure 20 is provided as a separately manufactured unit for mounting to the top of a container 22 (FIG. 1).

The container 22 typically has a conventional mouth or opening 24 (FIG. 4) which provides access to the container interior and product contained therein. The product may be, for example, a carbonated beverage or other comestible product. The product could also be any other solid, liquid, or gaseous material, including, but not limited to, a food product, a personal care product, an industrial or household cleaning product, a paint product, a wall patch product, or other composition (e.g., for use in activities involving manufacturing, commercial or household maintenance, construction, remodeling, agriculture, etc.).

Figure 4:
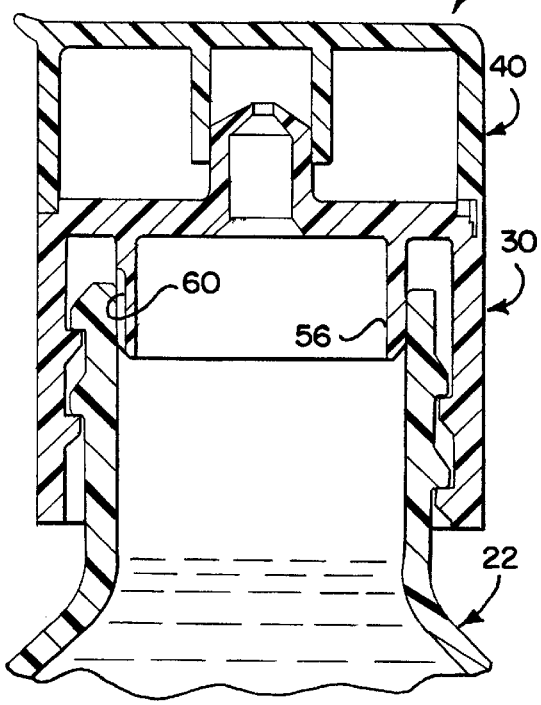
FIG. 4 is a view similar to FIG. 3, but FIG. 4 shows the structure after the pressure has equalized.

The container 22 may typically have a neck 26 or other suitable structure defining the container mouth 24 (FIG. 4). The neck 26 may have (but need not have) a circular cross-sectional configuration, and the body of the container 22 may have another cross-sectional configuration, such as an oval cross-sectional shape, for example. The container 22 may, on the other hand, have a substantially constant shape along its entire length (i.e., height) without any neck portion of reduced size or different cross-section.

The container 22 may typically be a squeezable container having a flexible wall or walls which can be grasped by the user and compressed to increase the internal pressure within the container 22 so as to squeeze the product out of the container 22 through the closure 22 when the closure 22 is open. Such a container wall typically has sufficient, inherent resiliency so that when the squeezing forces are removed, the container wall returns to its normal, unstressed shape. Such a structure is preferred in many applications, but may not be necessary or preferred in other applications. Indeed, the container 22 may be substantially rigid. A piston or other pressurizing system could be provided in such a rigid container to aid in dispensing a product, especially a relatively viscous product.

Figure 2:
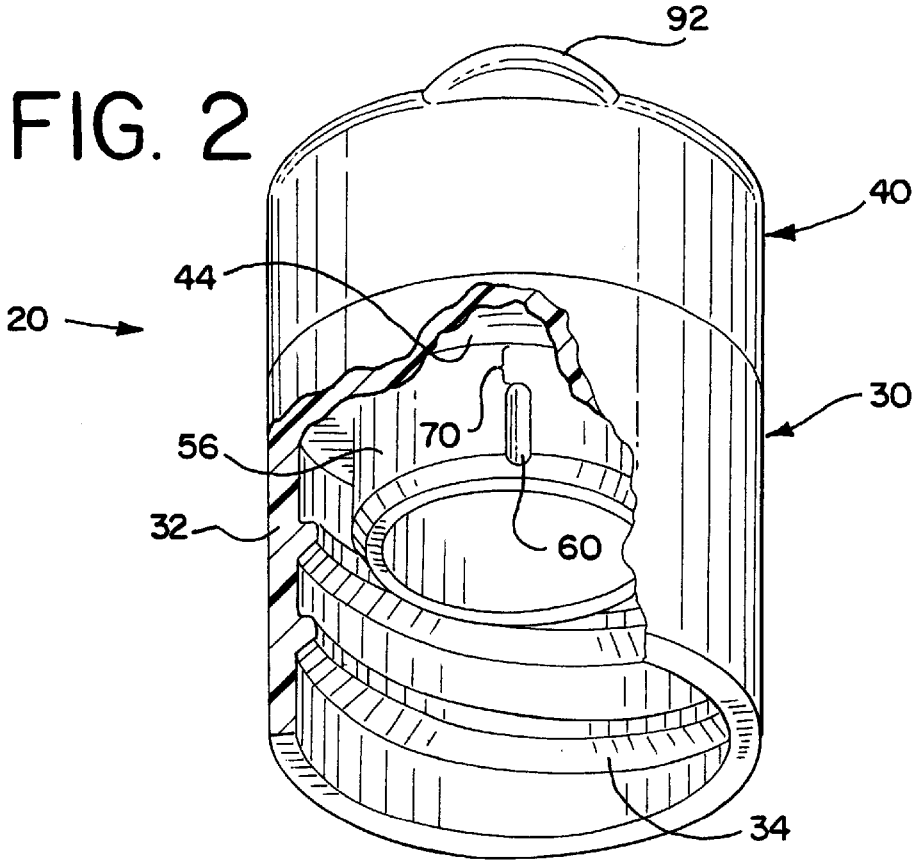
FIG. 2 is a perspective view of the underside of the closure shown in FIG. 1 prior to installation of the closure on the container.

As can be seen in FIGS. 1 and 2, the dispensing structure or closure 20 includes a base or body 30 and a lid 40 connected to the body 30.

The closure body 30 defines a skirt 32 (FIGS. 1 and 2) which has a conventional thread 34 for engaging a thread 36 (FIG. 1) on the neck of the container 22 (FIG. 4) to secure the closure body 30 to the neck 26 of the container 22.

The closure body 30 and container 22 could also be connected by other means, such as a telescoping connection, to accommodate axial movement of the closure body 30 relative to the container 22.

At the top of the closure skirt 32, the closure body 30 defines a radially inwardly extending, annular shoulder 42 (FIG. 1) and a raised deck 44. The shoulder 42 is adapted to receive the lid 40 seated thereon when the lid 40 is closed.

Projecting outwardly (i.e., upwardly in FIG. 1) from the closure body deck 44 is a spout 46 (FIG. 5) having an annular portion 48 with a frustoconical distal end 50 defining a dispensing orifice 52.

Preferably, as can be seen in FIGS. 1 and 2, a plug seal, in the form of an annular sealing member 56, projects downwardly from the underside of the closure body deck 44 adjacent the upper end of the container neck 26 so as to provide a leak-tight seal between the closure body 30 and the container neck 26 when the closure body 30 is in the first sealing position shown in FIGS. 1 and 2.

As can be seen in FIG. 2, the sealing member 56 defines at least one vent passage 60. In the embodiment illustrated in FIG. 2, the vent passage 60 is a generally vertically disposed, axially aligned groove in the surface of the sealing member 56. The bottom of the groove of the vent passage 60 extends to the bottom of the sealing member 56. The other end of the groove vent passage 60 (i.e., the upper or outer end of the vent passage 60) terminates somewhat below the underside of the closure body deck 44. The annular, outer surface of the sealing member 56 between the upper or outer end of the vent passage 60 and the bottom surface of the closure body deck 44 may be characterized as an outer sealing surface 70 (FIGS. 1 and 2). The outer sealing surface 70 is outwardly of the vent passage 60 and defines an annular sealing surface around the upper portion of the sealing member 56. As shown in FIG. 1, when the closure body 30 is in the lowered, first sealing position relative to the neck 26 of the container 22, the outer sealing surface 70 of the sealing member 56 is sealingly engaged with the inside annular surface of the container neck 26 which defines the container mouth or opening 24.

The lid 40 is preferably hingedly connected to the closure body 30 with a snap-action hinge 80 (FIG. 1). Such a hinge is disclosed in the U.S. Pat. No. 5,642,824, the disclosure of which is incorporated herein by reference thereto. In an alternate embodiment, the lid 40 need not be connected with a snap-action hinge. A floppy hinge may be used instead. Further, in another embodiment (not illustrated), no hinge at all need be employed. The lid 40 could be completely separate, and completely removable, from the closure body 30.

The lid 40 includes a sidewall or skirt 82 (FIGS. 1 and 2) from which the hinge 80 extends to the body 30. The bottom edge of the lid skirt 82 defines a seating surface 84 (FIGS. 1 and 4). When the lid 40 is closed, the seating surface 84 engages the annular shoulder 42 defined on the closure body 30 at the top of the closure body skirt 32.

Figure 5:
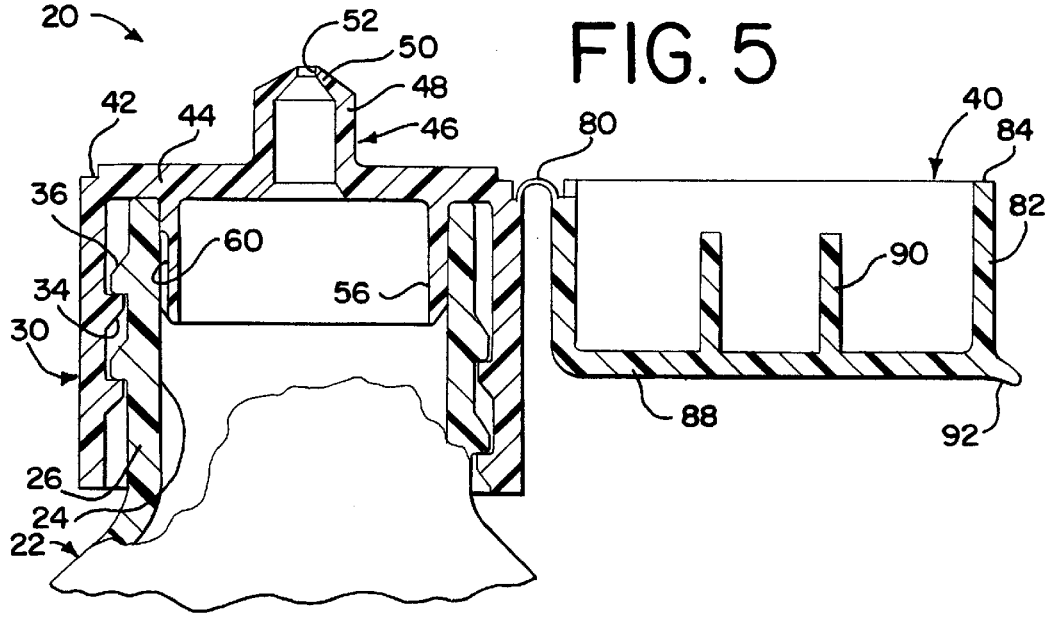
FIG. 5 is a view similar to FIG. 4, but FIG. 5 shows the closure moved back to the first sealing position and shows the lid in a full open position.

The top of the lid skirt 82 is closed by a top wall 88 (FIGS. 1 and 5).

Extending from the top wall 88 is a sealing sleeve 90 (FIGS. 1 and 5) which has an annular configuration. The lid sealing sleeve 90 is adapted to receive the spout 46 when the lid 40 is in the closed position (FIG. 1). The inside surface of the sleeve 90 seals against the outside surface of the spout annular portion 48. If desired, the lid 40 may also include a plug or spud (not illustrated) within the sleeve 90 for projecting into the closure body dispensing orifice 52 (FIG. 5) when the lid 40 is in the closed position. If a plug or spud is employed, then the annular sealing sleeve 90 could be omitted.

At the top edge of the lid 40, there is a finger lift or thumb tab 92 (FIGS. 1 and 2). The lid 40 can be opened by the user pushing upwardly on the tab 92 with a thumb or finger.

The container 22 is typically provided to a user filled with product and with the closure 20 mounted on the container 22 so that the closure body 30 is in the first sealing position (FIG. 1) and so that the lid 40 is in the closed position (FIG. 1). If the container 22 has an interior pressure which exceeds the ambient exterior pressure, the closure system of the present invention permits the pressure within the container to be equalized with the ambient exterior pressure prior to opening the lid and dispensing product. This may be especially useful or desirable when the container 22 contains a carbonated beverage or when the container 22 has been heated whereby the internal pressure has increased.

Figure 3:
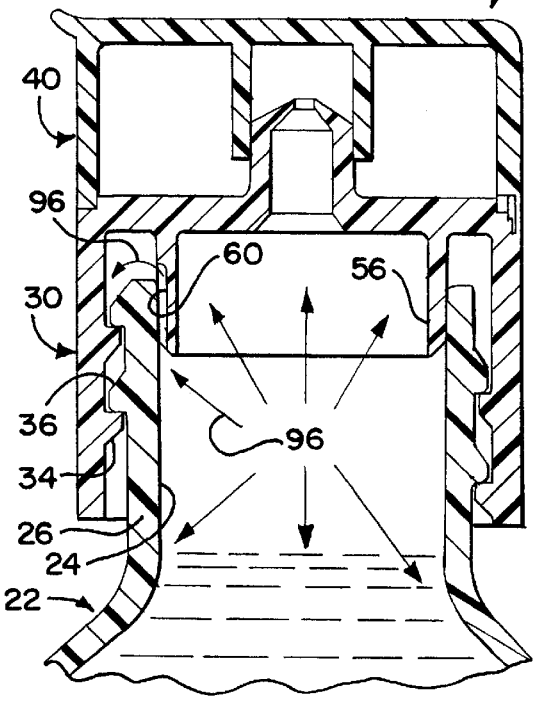
FIG. 3 is a view similar to FIG. 1, but FIG. 3 shows the closure moved upwardly or outwardly on the container to a venting position.

To operate the closure 20 in accordance with one aspect of the invention, the closure is moved by the consumer to a venting position (FIG. 3). In the first embodiment illustrated in FIGS. 1–5, the closure 20 is readily moved to the venting position by rotating the closure body 30 (along with the lid 40 attached thereto) in the unscrewing direction. This causes the closure body 30 to move axially in a direction away from the container. An appropriate mark or marks (or other indicia) may be provided on the exterior portion of the neck 26 of the container 22 to provide an indication for the user when the closure 20 has been rotated to a high enough position on the container neck 26 to establish the venting position.

As shown in FIG. 3, when the closure 20 is in the venting position, the vent passage 60 is positioned so that the upper end of the vent passage 60 extends beyond the top of the container neck 26. This defines a flow path between the container interior and the exterior of the container. FIG. 3 schematically illustrates pressurized gas 96 flowing outwardly from the container through the vent passage 60.

The pressurized gas 96 may readily flow through the threaded connection between the container neck threads 36 and the closure body threads 34 because such a conventional threading system is not leak-tight with respect to gases. Normal manufacturing tolerances employed in the dispensing closure industry are sufficient to accommodate passage of gas out of the container.

FIG. 4 shows the closure 20 and container 22 after sufficient gas has escaped from the container interior to equalize the container interior pressure with the exterior ambient pressure.

It will also be appreciated that the closure system may accommodate inventing of gas into the container. This would occur if the closure 20 is positioned in the venting position illustrated in FIG. 3 and if the pressure in the interior of the container 22 was less than the ambient exterior pressure. Such a condition could arise, for example, if the container had been cooled or if the container had previously been used to dispense some portion of the product at a reduced ambient atmospheric pressure, such as in a high altitude airplane.

It will be appreciated that the dispensing system may accommodate microwave cooking. For example, the container 22 could be provided to a user with a comestible product contained therein that is to be heated, or the container 22 could be provided to the user as an empty container which the user would fill with a comestible product to be heated. Subsequently, the user could position the closure in the venting position and then heat the container in a microwave oven. Vapor or other gases would be vented out through the vent passage 60. This would permit venting of the gases which would otherwise build up from a product within the container during such microwave heating. Thus, such a closure system provides convenience, as well as safety.

It will also be appreciated that closure 20 of the present invention may be used to permit the venting of gases that build up from a product within the container even when the container is not subjected to microwave energy. For example, over a period of time, some products can undergo a chemical reaction which may generate gases within the container and/or gas pressure may build up within the container owing to high ambient temperatures or reduction in ambient pressures (e.g., during airline transport).

After the container interior pressure has equalized with the exterior pressure, the user may rotate the closure body 30 back in the threading on direction so as to move the closure 20 in the direction toward the container 22 until the closure body 30 reaches the first sealing position (FIG. 1). In the first sealing position, the upper end of the vent passage 60 is now located below the top edge of the container neck 26. Thus, the annular, outer sealing surface 70 of the closure body sealing member 56 sealingly engages the interior surface of the container neck 26 and prevents leakage of gas or liquid out of the container.

Subsequently, with the closure body 30 in the first sealing position, the lid 40 can be opened, and the product can be dispensed through the closure body dispensing orifice 52.

Figures 6, 7, 8:
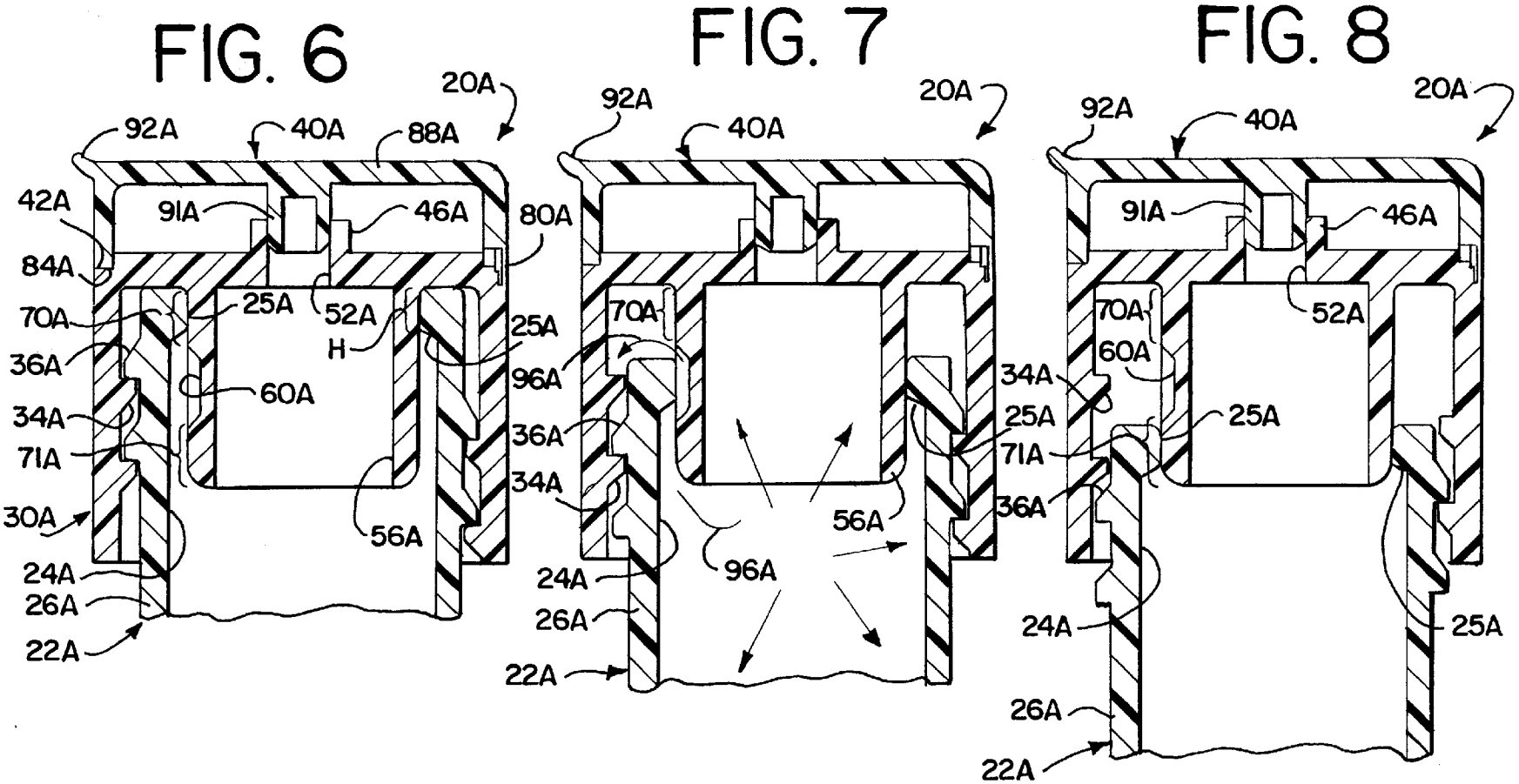
FIG. 6 is a cross-sectional view of a second embodiment of the dispensing structure of the present invention which comprises a separate closure that is mounted on a container in a first sealing position and that has an attached lid shown in a closed position.
FIG. 7 is a view similar to FIG. 6, but FIG. 7 shows the closure moved upwardly or outwardly on the container to a venting position.
FIG. 8 is a view similar to FIG. 7, but FIG. 8 shows the closure in a further outwardly moved position relative to the container to a second sealing position outwardly of the venting position.

FIGS. 6–8 illustrate a second embodiment of the dispensing structure of the present invention in the form of a dispensing closure 20A mounted on a container 22A. The container 22A has a neck 26A defining a mouth or opening 24A. At the top of the neck 26A, the container 22A includes a radially inwardly extending flange 25A. The flange has a height H as shown in FIG. 6. The exterior of the container neck 26A defines a thread 36A.

The closure 20A includes a base 30A and a lid 40A. The lid 40A is connected to the base 30A with a hinge 80A. The hinge 80A may be substantially identical with the hinge 80 described above for the first embodiment illustrated in FIGS. 1–5.

The closure body 30A includes a skirt 32A defining an internal thread 34A for engaging the container neck thread 36A. The closure body 30A includes a radially inwardly extending annular shoulder 42A (FIG. 6) and a raised deck 44A (FIG. 6). The shoulder 42A is adapted to receive the lid 40A seated thereon when the lid 40A is closed. Projecting outwardly (i.e., upwardly in FIG. 6) from the closure body deck 44A is a spout 46A which has an annular configuration and defines a dispensing orifice 52A.

The closure body dispensing orifice 52A is covered by the lid 40A when the lid is in the closed position as illustrated in FIGS. 6–8. The bottom edge of the lid 40A defines a seating surface 84A which is adapted to engage the closure body shoulder 42A when the lid 40A is closed. The lid includes a top wall 88A with a downwardly projecting plug or spud 91A for sealingly occluding the closure body dispensing orifice 52A when the lid 40A is closed. The lid 40A also includes a finger lift or thumb tab 92A which may be used by the user to lift the lid 40A to an open position permitting the container contents to be dispensed through the closure body dispensing orifice 52A.

The closure body 30A includes a sealing member 56A projecting downwardly from the underside of the closure body deck 44A. The sealing member 56A defines a vent passage 60A which, in the preferred form illustrated in FIGS. 6–8, is a channel having an upper end and a lower end. With reference to FIG. 6, the sealing member 56A may be characterized as having an annular outer sealing surface 70A extending from the upper end of the vent passage 60A to the underside of the closure body deck 44A. The sealing member 56A may be further characterized as having an annular inner sealing surface 71A extending between the lower end of the vent passage 60A and the bottom of the sealing member 56A.

Preferably, the vent passage 60A is a vertically disposed, axially aligned groove which is oriented between the outer sealing surface 70A and inner sealing surface 71A so that the outer sealing surface sealingly engages the container neck flange 25A when the closure body 30A is located at the first sealing position (FIG. 6). Thus, the height of the closure body sealing member annular outer sealing surface 70A is at least great enough to sealingly engage a portion of the inside annular surface of the container neck flange 25A when the closure 20A is in the first sealing position illustrated in FIG. 6.

In order to vent gases into or out of the container 22A, the closure 20A is unscrewed an amount sufficient to locate the vent passage 60A as shown in FIG. 7 wherein part of the vent passage 60A extends above the top edge of the container neck flange 25A and a part of the vent passage 60A extends below the bottom edge of the container neck flange 25A. This provides a flow path for gas into or out of the container. The gas can also readily pass through the threaded connection defined by the container neck threads 36A and closure body threads 34A.

As shown in FIG. 7, the closure lid 40A is maintained in the closed position when the closure 20A is moved to the venting position. In FIG. 7, a higher pressure gas flow out of the container is schematically illustrated by the arrows 96A.

After the pressure on the interior of the container 22A has equalized with the pressure on the exterior of the container 22A by gas venting out or venting in, the closure 20A may be moved either (1) back to the first sealing position (FIG. 6), or (2) further outwardly to a second sealing position (FIG. 8). In a presently contemplated preferred mode of operation, the closure 20A is moved outwardly to the second sealing position illustrated in FIG. 8. In the second sealing position illustrated in FIG. 8, the closure body sealing member inner sealing surface 71A seals against the container neck flange 25A below the bottom end of the vent passage 60A. At this point, the lid 40A can be opened to permit dispensing of the contents through the closure dispensing orifice 52A. If desired, the container neck 26A can be provided with markings or other indicia to identify for the user the elevation to which the closure should be unscrewed for the venting position (FIG. 7) and the increased elevation to which the closure should be unscrewed for the second sealing position (FIG. 8). Markings or other indicia may also be provided to identify the location of the first sealing position.

It will be appreciated that with either embodiment of closure that has been described, the vent passage 60 or 60A may have some other suitable configuration.

Further, two or more vent passages 60 or 60A may be provided in the sealing member. Each vent passage 60 or 60A need not have an elongate groove shape, but could have other shapes.

It will also be appreciated that the dispensing structure closure body (e.g., body 30 or body 30A) need not be threadingly engaged with the container neck.

Some other engagement may be employed which accommodates axial movement of the closure body relative to the container neck. For example, the closure body could be telescopically engaged for pure sliding movement inwardly or outwardly relative to the container neck. An appropriate travel stop engagement could be provided to prevent the closure body from being pulled completely off of the container neck. Detents could be provided to identify the venting position and sealing positions.

It will be readily observed from the foregoing detailed description of the invention and from the illustrations thereof that numerous other variations and modifications may be effected without departing from the true spirit and scope of the novel concepts or principles of this invention.

What is claimed is:

1. A dispensing structure for discharging the contents from the interior of a container out of an opening in said container, said dispensing structure comprising:

a body for mounting to said container at said opening for movement in directions toward and away from said container, said body defining a dispensing orifice for establishing communication between the exterior and interior of said container, and said body having a sealing member for being disposed in said container opening, said sealing member having an outer sealing surface for sealingly engaging said container around said container opening when said body is located at a first sealing position relative to said container, said sealing member defining a vent passage extending inwardly from said outer sealing surface for communicating with the container interior whereby movement of said body in the direction away from said container a sufficient amount to a venting position locates a portion of said vent passage outwardly of said container opening to establish communication between the container interior and the container exterior; and a lid accommodating movement between (1) a closed position occluding said body dispensing orifice for preventing the dispensing of the container contents through said body dispensing orifice, and (2) an open position away from said body dispensing orifice to accommodate pouring of the contents from the container through said body dispensing orifice;

said container having a flange at said container opening;

said sealing member having an inner sealing surface; and said vent passage being a groove that is oriented between said inner and outer sealing surfaces so that (a) said outer sealing surface sealingly engages said flange when said body is located at said first sealing position, (b) said groove extends from outside said flange to inside said flange when said body is in said venting position, and (c) said inner sealing surface sealingly engages said flange when said body is in a second sealing position outwardly of said venting position.

2. The dispensing structure in accordance with claim 1 in which said body is formed separately from said container; and said body has a skirt with an internal thread for threadingly engaging an external thread on said container to permit said body to be rotatably mounted to said container to accommodate axial movement of said body in said directions toward and away from said container.

3. The dispensing structure in accordance with claim 1 in which said lid is hingedly connected to said body.

4. The dispensing structure in accordance with claim 1 in which said body includes a spout; and said spout has a sealing surface for being sealingly engaged by said lid.

5. The dispensing structure in accordance with claim 1 in which said dispensing structure is defined by a closure which is separate from, but releasably attachable to, said container;

said body defines a body of said closure; and said lid defines a lid of said closure.

6. The dispensing structure in accordance with claim 1 in which said body seal member is a generally annular plug.

7. The dispensing structure in accordance with claim 1 in which said seal member has a peripheral surface; and said vent passage is a groove in said seal member peripheral surface.

* * * * *